US007618254B2

(12) United States Patent
Gartz

(10) Patent No.: US 7,618,254 B2
(45) Date of Patent: Nov. 17, 2009

(54) METHOD FOR IGNITING A BURNER

(75) Inventor: Mats Gartz, Sollentuna (SE)

(73) Assignee: AGA AB, Lindingö (SE)

( * ) Notice: Subject to any disclaimer, the term of this patent is extended or adjusted under 35 U.S.C. 154(b) by 563 days.

(21) Appl. No.: 11/377,040

(22) Filed: Mar. 16, 2006

(65) Prior Publication Data

US 2007/0190470 A1 Aug. 16, 2007

(30) Foreign Application Priority Data

Feb. 2, 2006 (SE) ..... 0600220

(51) Int. Cl.
*F23Q 13/00* (2006.01)

(52) U.S. Cl. ..... 431/6; 431/2; 431/79; 431/254; 431/256

(58) Field of Classification Search ..... 431/2, 431/6, 79, 254, 256; 250/554; 340/578
See application file for complete search history.

(56) References Cited

U.S. PATENT DOCUMENTS

| | | | | | |
|---|---|---|---|---|---|
| 2,840,146 | A | * | 6/1958 | Ray | 431/79 |
| 3,076,495 | A | * | 2/1963 | Ray et al. | 431/15 |
| 3,427,118 | A | * | 2/1969 | Kuchelbacher et al. | 431/258 |
| 3,434,788 | A | * | 3/1969 | Wright | 431/66 |
| 3,473,879 | A | * | 10/1969 | Berberich | 431/1 |
| 3,574,501 | A | * | 4/1971 | Mitts | 431/254 |
| 3,613,062 | A | * | 10/1971 | Bloice | 431/13 |
| 3,689,773 | A | * | 9/1972 | Wheeler | 250/554 |
| 3,825,913 | A | * | 7/1974 | Metcalf et al. | 340/578 |
| 3,938,932 | A | * | 2/1976 | Benzan | 431/2 |
| 4,039,844 | A | * | 8/1977 | MacDonald | 250/554 |
| 4,113,419 | A | * | 9/1978 | Cade | 431/78 |
| 4,163,903 | A | * | 8/1979 | Robertson | 250/554 |
| 4,302,933 | A | * | 12/1981 | Smith | 60/761 |
| 4,395,224 | A | * | 7/1983 | Cade | 431/31 |
| 4,709,155 | A | * | 11/1987 | Yamaguchi et al. | 250/554 |
| 4,947,640 | A | * | 8/1990 | Few et al. | 60/776 |
| 5,488,355 | A | * | 1/1996 | Tindall et al. | 340/578 |
| 5,798,946 | A | * | 8/1998 | Khesin | 700/274 |
| 2001/0020469 | A1 | * | 9/2001 | Hunt | 123/549 |

FOREIGN PATENT DOCUMENTS

| | | | |
|---|---|---|---|
| DE | 3736417 | * | 5/1988 |
| DE | 3731046 | * | 1/1989 |
| EP | 506579 A1 | * | 9/1992 |

(Continued)

*Primary Examiner*—Carl D Price
(74) *Attorney, Agent, or Firm*—Alfred J. Mangels

(57) ABSTRACT

A method for igniting a fuel/oxidant mixture in an industrial furnace. At least one fuel supply conduit and at least one oxidant supply conduit is provided, each conduit having an opening that opens on a side of the burner head that faces the furnace interior space. Fuel and oxidant are supplied to the burner head, and a light detector for detecting ultraviolet light, or other light wavelengths, is provided for detecting light that indicates the presence of a flame. A laser is positioned to emit a laser beam onto a point on the burner head adjacent the conduit outlets and to heat that point to a temperature exceeding the ignition temperature of the fuel/oxidant mixture. When the burner has ignited, the detector emits a signal to a control circuit that extinguishes the laser beam.

7 Claims, 1 Drawing Sheet

FOREIGN PATENT DOCUMENTS

| | | | | |
|---|---|---|---|---|
| JP | 55051236 | A | * | 4/1980 |
| JP | 59221523 | A | * | 12/1984 |
| JP | 61173014 | A | * | 8/1986 |
| JP | 62125218 | A | * | 6/1987 |
| JP | 62153614 | A | * | 7/1987 |
| JP | 02259323 | A | * | 10/1990 |
| WO | WO 0169136 | | * | 9/2001 |

* cited by examiner

METHOD FOR IGNITING A BURNER

BACKGROUND OF THE INVENTION

1. Field of the Invention

The present invention relates to a method for igniting a burner, especially a burner that is used in industrial furnaces.

2. Description of the Related Art

There exist burners of various kinds, having in common that a gaseous fuel and a gaseous oxidant are introduced near or at a distance from each other into a combustion zone within a furnace. The gases are usually introduced through lances in a burner head.

For safety reasons, a burner needs to be monitored with respect to whether a flame is present during operation. Such monitoring is usually carried out by the use of a UV sensor, which is a sensor that is sensitive to and that detects ultraviolet radiation. The sensor is usually mounted in the burner in such a way that the sensor can detect a part of an existing flame.

Ignition of the fuel/oxidant mixture normally takes place by means of a spark plug at the outlet or outlets of the burner, to emit a spark for igniting the fuel/oxidant mixture. An electrode is commonly mounted inside a ceramic tube that extends up to the surface of the burner head that faces the furnace interior space. The ceramic tube has a relatively low strength and is therefore easily broken. The tube can also crack because of thermal stresses.

In addition to the problems noted above relative to the ceramic tube, it has developed that it is relatively difficult to obtain a correct electric arc. During furnace operation the spark plug often gets clogged, and as a result it cannot give off a sufficient spark for igniting the fuel/oxidant mixture.

Also, it is usual practice that the spark ignites a pilot flame, which in turn ignites the main flame. That arrangement increases the cost.

The present invention solves these problems by providing another way of igniting a burner.

SUMMARY OF THE INVENTION

Thus, the present invention relates to a method for use when burning a fuel together with an oxidant in an industrial furnace. The fuel and the oxidant are supplied to a burner head, and the flame is monitored by a light detector for ultraviolet light, or for detecting other light. At least one fuel supply conduit and at least one oxidant supply conduit are provided, each of which includes an outlet opening that opens on the side of the burner head that faces the furnace interior. A laser is provided to emit a laser beam onto a contact point on the burner head adjacent the fuel and oxidant conduit outlets. The laser beam heats the contact point to a temperature that is above the ignition temperature of the fuel and the oxidant, and when the burner has ignited the light detector emits a signal to a control circuit that turns off the laser beam.

BRIEF DESCRIPTION OF THE DRAWING

The structure, operation, and advantages of the present invention will become further apparent upon consideration of the following description, taken in conjunction with the accompanying drawing in which.

DESCRIPTION OF THE PREFERRED EMBODIMENTS

Figure 1:
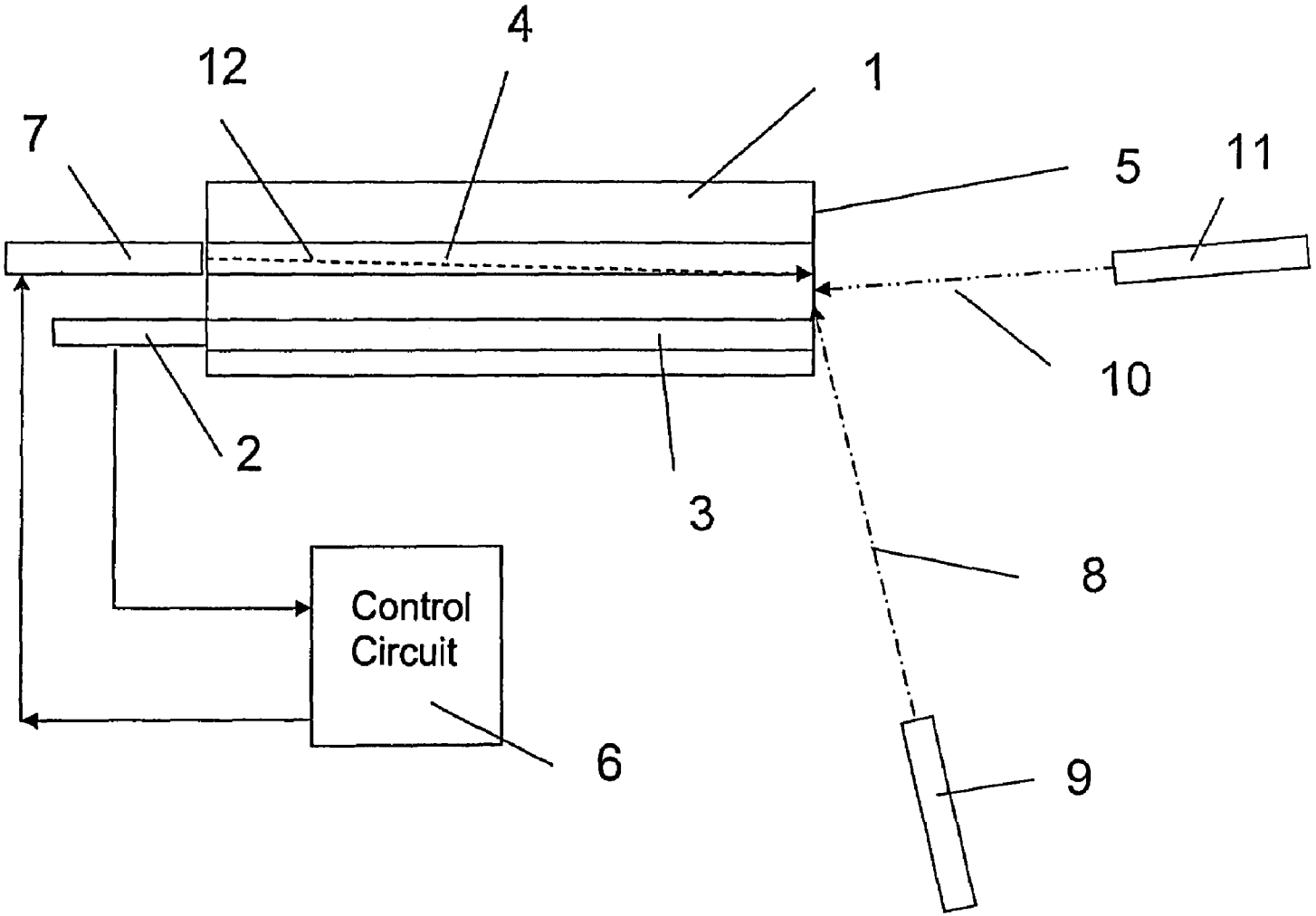
FIG. 1 schematically shows a longitudinal section of a burner head and associated ignition components in accordance with an embodiment of the present invention.

FIG. 1 shows a burner for the combustion of a fuel together with an oxidant in an industrial furnace. The burner is arranged in such away that fuel and oxidant are supplied to the burner head 1. A light detector 2 for the detection of ultraviolet light, or light of other wavelengths, is provided in order to detect the presence of a flame outside the burner head.

In accordance with the invention, there is provided at least one fuel supply conduit 3 and at least one oxidant supply conduit 4, each of which opens at a respective outlet at the outer surface 5 of the burner head that faces the furnace interior.

It is evident that the fuel and oxidant conduits can be configured and positioned in other ways, and that they can number more than two.

Light detector 2 can be provided adjacent the inlet of the fuel supply conduit 3, or adjacent the inlet of the oxidant supply conduit 4. Conveniently, the detector is provided at the upstream end of the associated conduit, and is positioned so that ultraviolet light that passes into the conduit from the flame impinges upon the detector. The detector is connected to a control circuit 6 that includes a detector circuit, by which the existence of a flame at the burner outlet is detected. If a flame is not detected by the light detector the supply of fuel and oxidant to the burner head is interrupted.

For use with the present invention, oxidants with an $O_2$ content of over 85 percent by weight are preferred. The fuel can be natural gas, propane, butane, liquefied petroleum gas, light fuel oil, etc.

The oxidant is introduced into the combustion space within the furnace through one or several nozzles, which can be formed as straight tubes, or as Laval or venturi nozzles.

In accordance with the invention, a laser, such as laser 7, 9, or 11, is positioned to emit a laser beam on a point on the burner head near the conduit outlets, and is made to heat that point to a temperature that exceeds the ignition temperature of the fuel/oxidant mixture. When the burner 1 has been ignited and a flame is detected by the light detector 2, the detector emits a signal to the control circuit 6, after which the control circuit turns off the laser 7.

The laser is a suitable, known laser with a sufficient output power to heat the point on the burner head to a temperature greater than 700-800° C. within a short period of time, such as within a few seconds. That condition will result in a very reliable ignition. When the fuel and oxidant mixture ignites, the detector 2 detects a flame, indicating ignition, and emits a signal to the control circuit 6 at the moment of ignition, at which time the control circuit immediately turns off the laser. Even if the laser has a sufficient power to quickly heat the point on the burner head to the above-mentioned temperatures, it will not melt the material at any point on the burner head because of the rapid extinction of the beam from the laser.

Instead of impinging on a point on the burner head, the laser beam can impinge on, for example, a protrusion of suitable metal (not shown), that projects from the burner head. The important factor is that the point that the laser beam impinges upon is adjacent to or located along the path of transportation of the fuel/oxidant mixture.

In accordance with a preferred embodiment, a laser beam impinges upon a point on or adjacent to the side of the burner head facing the furnace interior space and between the outlets of conduits 3, 4.

In accordance with another preferred embodiment, a laser beam is directed at an angle slightly less than a right angle with respect to the longitudinal axis of the burner 1, as is illustrated by laser beam 8 emitted by laser 9 in FIG. 1.

In accordance with an alternative embodiment, a laser beam is directed toward the outer surface of the burner head that faces the furnace interior space, and in a direction coinciding substantially with the longitudinal axis of the burner 1, as illustrated by laser beam 10 emitted by laser 11 in FIG. 1.

In accordance with an alternative embodiment a laser beam 12 is emitted from laser 7 in such a way that it extends within one of the oxidant supply conduits 4, and in a direction toward the outer surface 5 of the burner head 1 that faces the furnace interior space. In that arrangement the laser beam 12 impinges on the inner surface of the conduit 4 adjacent to its outlet opening at burner head outer surface 5, as is also illustrated in FIG. 1.

Different embodiments have been described above. The laser can be of various known models, and it can be directed toward any suitable point on the burner head. The laser can be integrated into the burner head or can be separate therefrom.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A method for igniting a burner in an industrial furnace, said method comprising the steps of: supplying fuel and oxidant to a burner head including at least one conduit for the supply of fuel and at least one conduit for the supply of oxidant, wherein the oxidant has an oxygen content of over 85% by weight, and wherein the conduits extend to respective conduit outlets at a burner head outer surface that faces a furnace interior space; directing a laser beam onto a beam contact point on the burner head outer surface adjacent to the conduit outlets and in a region in which an ignitable fuel-oxidant mixture is present to heat the beam contact point to a temperature that exceeds the ignition temperature of the fuel/oxidant mixture; detecting the existence of a flame outside the burner head by a light detector; emitting a signal from the light detector to a control circuit when the fuel/oxidant mixture has been ignited and a flame is detected by the light detector; and providing a signal from the control circuit to turn off the laser beam after a flame is detected.

2. A method in accordance with claim 1, including the step of directing the laser beam onto an area of the burner head outer surface that lies between the conduit outlets.

3. A method in accordance with claim 1, including the step of directing the laser beam at the burner head outer surface at an angle less than a right angle with respect to a longitudinal axis of the burner.

4. A method in accordance with claim 1, including the step of directing the laser beam at the burner head outer surface in a direction coinciding substantially with a longitudinal axis of the burner.

5. A method in accordance with claim 1, including the steps of: directing the laser beam to extend within one of the conduits and toward the burner head outer surface; and heating an inner surface of the conduit adjacent its outlet.

6. A method in accordance with claim 1, wherein the light detector detects ultraviolet light emitted by a flame.

7. A method in accordance with claim 1, wherein the temperature at the point on the burner head outer surface is greater than 700° C.

* * * * *